US005688168A

United States Patent [19]

Schlies

[11] Patent Number: 5,688,168

[45] Date of Patent: Nov. 18, 1997

[54] FUME HOOD WITH IMPROVED COUNTERBALANCE SYSTEM

[75] Inventor: James J. Schlies, Denmark, Wis.

[73] Assignee: Fisher Hamilton Scientific Inc., Two Rivers, Wis.

[21] Appl. No.: 596,656

[22] Filed: Feb. 5, 1996

[51] Int. Cl.[6] ..... B08B 15/02

[52] U.S. Cl. ..... 454/56; 49/445

[58] Field of Search ..... 454/56, 62; 49/445, 49/446

[56] References Cited

U.S. PATENT DOCUMENTS

| | | | |
|---|---|---|---|
| 3,934,496 | 1/1976 | Turko | 454/56 |
| 5,241,788 | 9/1993 | Buie | 454/62 X |

FOREIGN PATENT DOCUMENTS

| | | | |
|---|---|---|---|
| 82219 | 10/1956 | Denmark | 49/447 |
| 1 045 072 | 11/1958 | Germany | 49/447 |
| 23 63 665 | 6/1975 | Germany | 49/445 |
| 329881 | 9/1935 | Italy | 49/447 |

*Primary Examiner*—Harold Joyce

*Attorney, Agent, or Firm*—Tilton, Fallon, Lungmus & Chestnut

[57] ABSTRACT

A fume hood includes a housing with a work chamber, an access opening to the work chamber, and a sash that one may move between raised and lowered positions to open or close the access opening. It also includes a counterbalance system that maintains the sash at a desired position between two predetermined limits. An adjusting weight system reduces the weight provided by the counterbalance system or increases the weight of the sash to allow the sash to drop to a predetermined position after it has moved above that predetermined position.

16 Claims, 2 Drawing Sheets

FUME HOOD WITH IMPROVED COUNTERBALANCE SYSTEM

BACKGROUND OF THE INVENTION

1. Field of the Invention

The present invention relates to a fume hood with an improved counterbalance system, and more particularly to a fume hood with a movable sash, a counterbalance weight means and an adjusting weight means that reduces the weight provided by the counterbalance weight means or increases the weight of the sash once the sash of the fume hood has moved above a predetermined position to allow the sash to drop slowly and safely to the predetermined position. Although the present invention finds particular utility in fume hoods, it may provide a balancing function in a variety of other applications that include a movable sash.

2. Description of the Prior Art

A fume hood generally includes a housing that defines a work chamber and a front opening with a sash slidably mounted to the housing portions proximate the front opening for opening or closing the opening. It also includes components for bringing utilities such as gas, compressed air, water and electricity to the work space and components such as a blower and conduits for evacuating the work space of fumes, some of which may be hazardous.

In addition to the structures outlined above, a fume hood typically includes a counterbalance system comprising one or more weights and one or more cables that counter the weight of the sash and the various forces that act on it to maintain the sash at a desired position. This counterbalance system may include two sash weights concealed within opposite front corners of the fume hood and connected to the sash by cables that extend over pulleys at the top of the hood. Alternatively, it may include a single weight disposed at the back of the fume hood and connected to the sash by a single cable that extends over pulleys rotatably mounted at various positions on the hood. Turko U.S. Pat. No. 3,934,496 that issued on Jan. 27, 1976 describes this alternative system.

When one uses a fume hood, he or she typically opens the sash to a desired level, places any equipment he or she may need to use in the work space, and lowers the sash to a second level, leaving only enough space for reaching into the work space and performing desired operations. The operator then activates the fume hood including the blower which vents fumes out of the work space. If the operator leaves the sash at a raised level, the blower operates at an increased speed to prevent the fumes from migrating out of the work space through the access opening. At or proximate the fully open position of the sash, the blower may not have the capacity for preventing this undesired migration.

Thus, a fume hood should include means that reduce the risk of fume migration from the work space. These means should accomplish this result automatically without the need of costly sensors and controls that make the fume hood unnecessarily complex and susceptible to malfunction. Finally, these means should not expose the operator to injury.

The fume hood of the present invention includes such means. It includes adjusting weight means that reduces the weight provided by the counterbalance weight or increases the weight of the sash once the sash has moved above a predetermined position. This apparatus allows the sash to drop slowly and safely to the predetermined position. It is a simple construction which minimizes the expense of manufacture and assembly and provides reliable and effective closure of the sash.

SUMMARY OF THE INVENTION

In accordance with one embodiment of this invention, a fume hood includes a housing with a work chamber, an access opening for the work chamber, and a sash member moveable between raised and lowered positions for opening or closing the access opening. Counterbalance weight means normally maintain the sash member at a desired position; and adjusting weight means reduce the weight provided by the counterbalance means or increase the weight of the sash to allow the sash member to drop to a predetermined position after it has moved above that predetermined position. In this embodiment, the adjusting weight means includes a main body portion and a portion that connects the adjusting weight means to the sash member. Alternatively, the adjusting weight means may include a main body portion and a portion that connects the adjusting weight means to the counterbalance weight means.

BRIEF DESCRIPTION OF THE DRAWINGS

For a more complete understanding of this invention, one should now refer to the embodiment illustrated in greater detail in the accompanying drawings and described below by way of an example of the invention. In the drawings.

While the following disclosure describes the invention in connection with one embodiment and modifications of that embodiment, one should understand that the invention is not limited to this embodiment and modifications. Furthermore, one should understand that the drawings are not to scale and that graphic symbols, diagrammatic representatives, and fragmentary views, in part, illustrate the embodiment. In certain instances, the disclosure may not include details which are not necessary for an understanding of the present invention such as conventional details of fabrication and assembly.

DETAILED DESCRIPTION OF THE DRAWINGS

Figure 1:
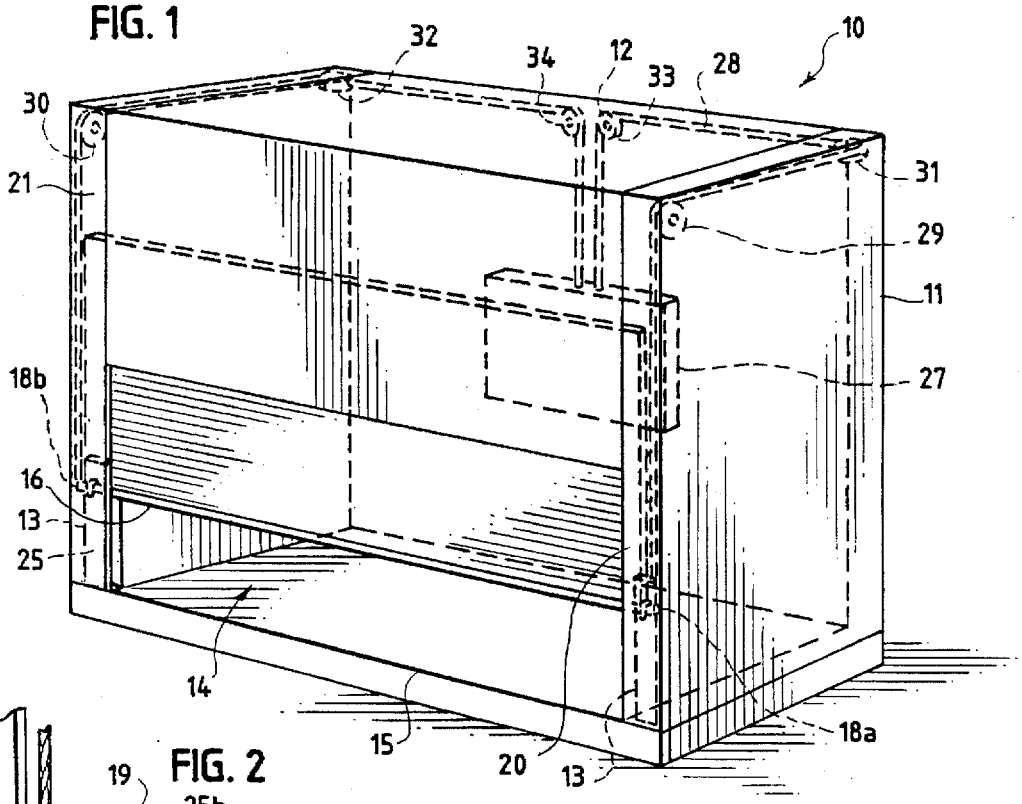
FIG. 1 is a perspective view of the fume hood of the present invention with the counterbalance weight means and the adjusting weight means shown with hidden lines.

In the illustration given and with reference to FIG. 1, the numeral 10 designates the fume hood of the present invention. This fume hood 10 generally includes a housing 11, a counter-balance assembly 12, adjusting weight means 13, and an exhaust system (not shown), including exhaust conduits and a blower. The housing defines a work chamber 14 and a front opening 15 through which one gains access to the work space 14; and it includes a sash member 16 slidably mounted to the housing for opening or closing the front, access opening 15.

Figure 2:
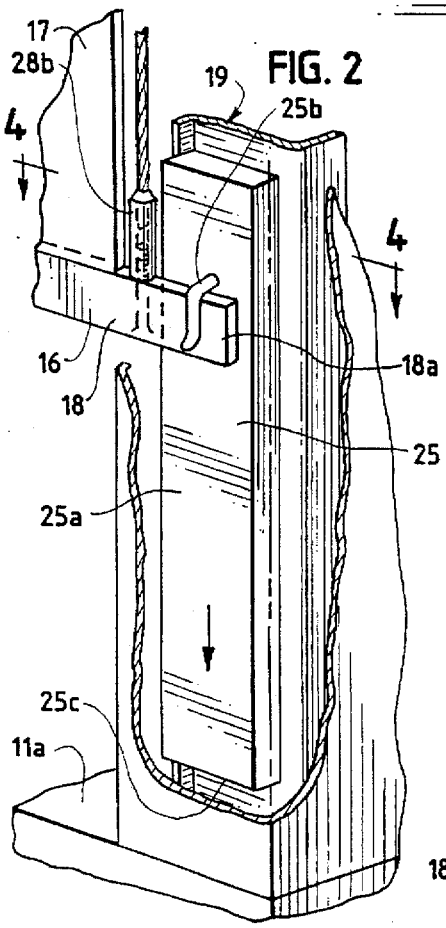
FIG. 2 is an enlarged, partial perspective view of the fume hood of the present invention, showing an adjusting weight in a raised position.
Figure 3:
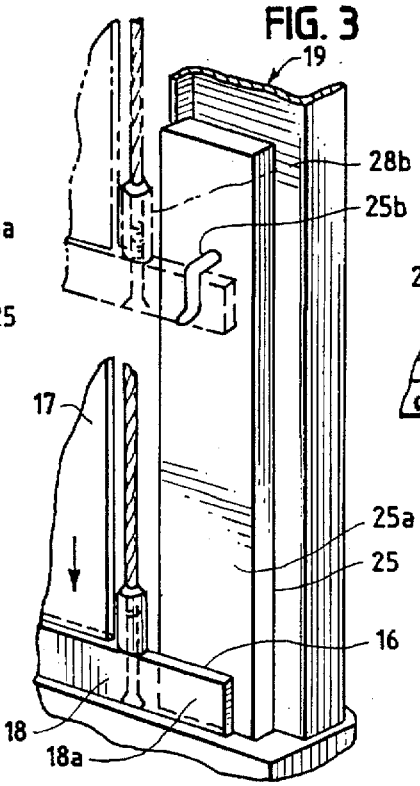
FIG. 3 is the view of FIG. 2, showing the adjusting weight in a lowered position.
Figure 4:
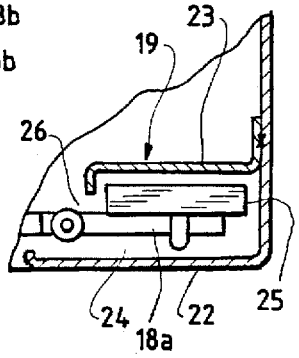
FIG. 4 is a sectional view taken along line 4—4 in FIG. 2.

The sash member 16 includes a rectangular glass panel 17, a lower edge mount or frame member 18, and side and top edge mounts or frame members (not shown). An end portion 18*a* of the lower edge mount 18 extends into a corner post assembly 19 (as shown in FIGS. 2–4) disposed along one front vertical edge 20 of the housing 11; and an opposite end portion 18*b* of the lower edge mount 18 extends into a second corner post assembly (not shown) disposed along the opposite front vertical edge 21 of the housing 11. (The two corner post assemblies generally have the same size and configuration; they slidably receive the end portions of the frame member 18; and they contain the adjusting weight means 13 as described below.)

The corner post assembly 19 comprises a generally L-shaped wall portion 22 and a wall segment 23 welded or otherwise secured together to define an elongate hollow center 24 that contains an adjusting weight 25 of the adjusting weight means 13 and a vertically extending slot 26 through which the assembly receives the end portion 18*a* of the lower edge mount 18 (See FIG. 4). The wall portions and segments of the corner post assembly 19, as well as the remaining wall portions of the housing 11, are made of sheet metal or any other material of high strength and rigidity. Moreover, similarly configured wall portions and segments form the other wall post assembly disposed along the opposite vertical front edge 21. This wall post assembly contains a second adjusting weight 25 of the adjusting weight means 13; and it receives the end portion 18*b* of the lower edge mount 18.

The counterbalance assembly 12 maintains the sash member 16 at desired positions along its vertical path. It includes a counterweight 27, a cable 28 for connecting the counterweight 27 to the sash member 16, and three pairs of pulleys 29 and 30, 31 and 32, and 33 and 34 rotatably mounted at predetermined positions on the housing 11 (as shown in FIG. 1). Connectors 28*b* secure the cable 28 to the sash member 16 and to the counterweight 27. The pulleys 29–34 route the cable 28 upwardly from opposite ends of the lower edge mount 18 of the sash member 16, rearwardly over the top of the hood, laterally inwardly to the middle portion of the hood's back, and downwardly behind the back wall of the hood to the counterweight 27. Turko U.S. Pat. No. 3,934,496 titled "Counterbalance Mechanism For Fume Hoods" that issued on Jan. 27, 1976 more fully describes the counterbalance assembly 12 shown in FIG. 1, and this disclosure incorporates the disclosure of that patent by this reference.

Alternatively, the fume hood of the present invention may include any counterbalance assembly that similarly maintains the sash member 16 at desired positions along its vertical path. For example, an alternate counterbalance assembly may include two counterweights concealed in vertical tubes disposed behind the corner post assemblies that contain the weight balancing means 13. It may also include two cables that connect the counterweights to the sash member and two pulleys that route the cable over the top of the hood. (This alternative assembly is one of a number of available conventional counterbalance assemblies.)

As stated above, the adjusting weight means 13 includes two adjusting weights 25. (Alternatively, the adjusting weight means may include just one weight 25.) Each of the weights 25 includes a main body portion 25*a* and a hook portion 25*b* disposed a predetermined distance from a bottom end 25*c* of the weight. The two portions may be solid pieces of any suitable material fixedly secured together provide the requisite weight. Although this embodiment includes a rectangular main body portion for each adjusting weight 25, the main body portion, as well as the hook portion, may have any suitable shape. The portions of the two adjusting weights 25 may also have different configurations with corresponding different configurations for the corner post assemblies. As a further modification, these main body portions may be hollow housings made of sheet metal or the like and filled with ballast or weight material (e.g., scrap metal). This modification allows adjustment of the magnitude of each balancing weight.

In operation, the hook portions of the adjusting weights 25 receive the end portions of the lower edge mount 18 at a predetermined distance above the base 11*a* of the housing 11. The weights 25 then remain hanging from the sash member 16 for any remaining vertical movement of the sash member. Accordingly, these weights 25 add to the weight of the sash member 16 and effectively reduce the weight of the counterbalance. In this way, the balancing weights 25 allow the sash member 16 to drop to the position at which the sash receives the weights 25 after the sash member has moved above that position. Thus, the predetermined distance between the base of the housing 11 and that position is the height of the opening to which the sash member will automatically correct if raised any further. (By selecting the proper weight for the weights 25 one may adjust the speed at which the sash 16 drops to produce a slow and smooth movement.)

Figure 5:
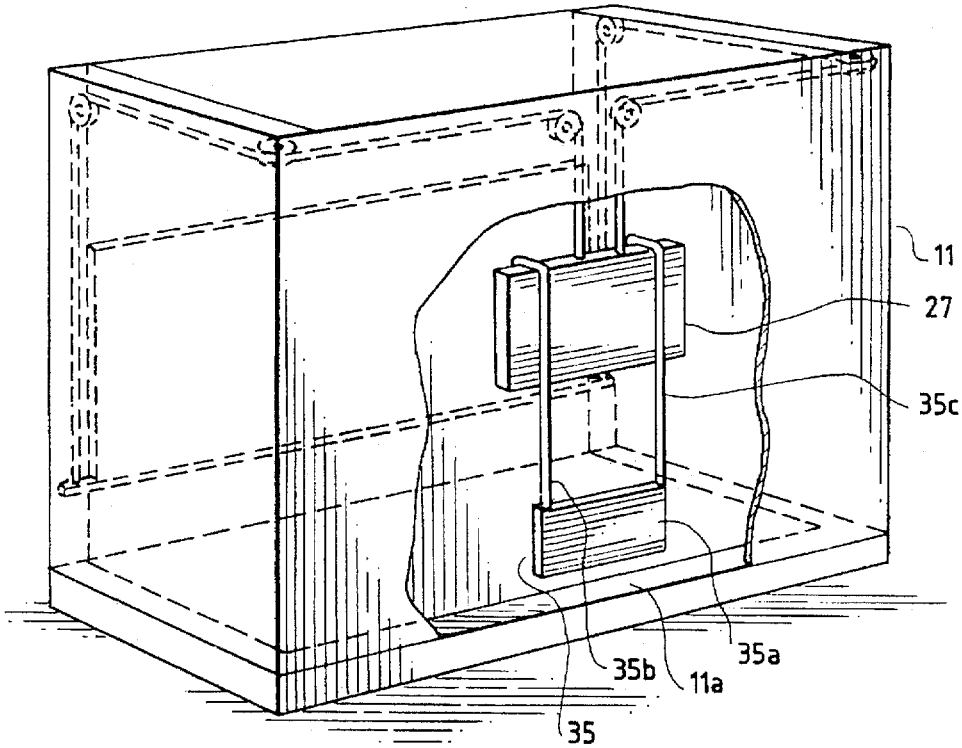
FIG. 5 is a perspective view of a fume hood of the present invention with a rear panel cut away to show an alternative adjusting weight disposed in a raised position.
Figure 6:
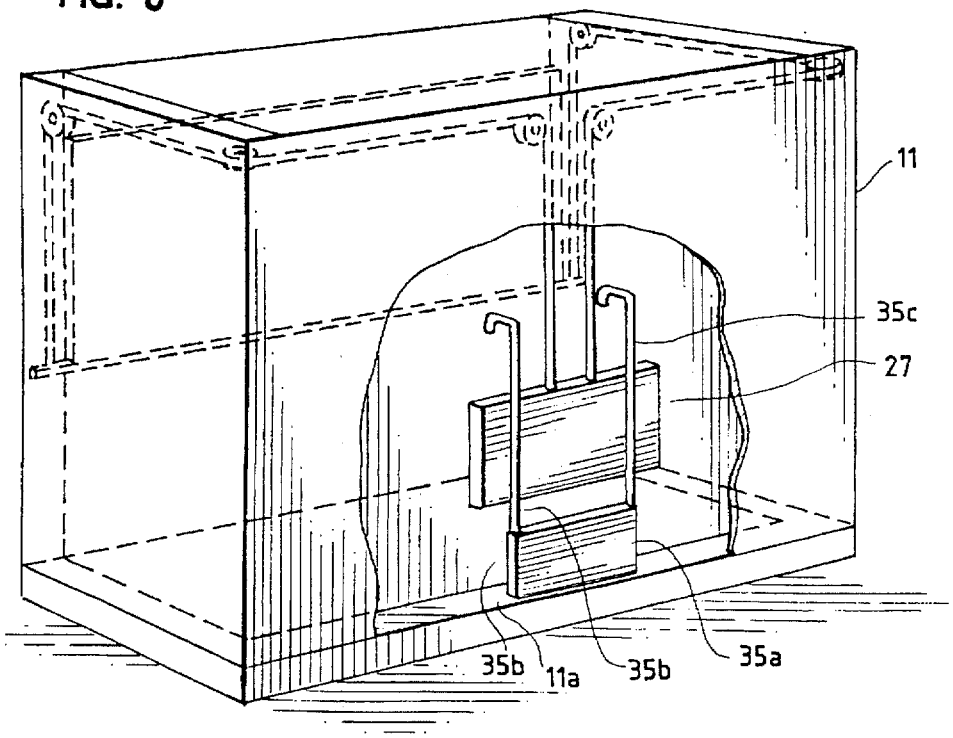
FIG. 6 is the view of FIG. 5, showing the alternative adjusting weight in a lowered position.

Referring now to FIGS. 5 and 6, an alternative to the adjusting weights 25 comprises an adjusting weight 35 disposed in the rear wall of the fume hood proximate the counterweight 27. This weight 35 includes a main body portion 35*a* and hook portions 35*b* and 35*c*. The hook portions 35*b* and *c* receive the top edge portion of the counterweight 27 at a predetermined distance above the base 11*a* as the counterweight 27 moves upwardly. The weight 35 then remains hanging from the counterweight 27 for the remaining upward movement of the counterweight 27. (With this alternative, the combined magnitude of the weights 27 and 35 equals the magnitude of the counterweight 27 in the embodiment described above.) This alternative achieves the same result as the one in the embodiment described above by removing weight directly from the counterbalance rather than adding it to the sash.

While the above description and the drawings disclose and illustrate one embodiment and various modifications, one should understand, of course, that the invention is not limited to this embodiment and modifications. Those skilled in the art to which the invention pertains may make other modifications and other embodiments employing the principles of this invention, particularly upon considering the foregoing teachings. For example, the adjusting weight or weights 25 may include a main body portion and a cable of predetermined length connected at one end to the main body portion and at a second, opposite end to sash member 16. In this alternative, the length of the connecting cable determines the height to which the sash member 16 automatically corrects.

Therefore, by the appended claims, the applicant intends to cover any modifications and other embodiments as incorporate those features which constitute the essential features of this invention.

What is claimed is:

1. In a fume hood apparatus having a housing with a work chamber, an access opening to the work chamber, and a sash member moveable between raised and lowered positions for opening or closing the access opening, counterbalance means for normally maintaining the sash member at a desired position and adjusting weight means for adjusting the weight provided by the counterbalance means or increasing the weight of the sash member at a predetermined point during the movement of the sash between the raised and lowered positions to allow the sash member to drop to a predetermined position after being raised above that predetermined position.

2. The fume hood apparatus of claim 1, wherein the counterbalance means includes a first weight member and a cable for connecting the first weight member to the sash member.

3. The fume hood apparatus of claim 2, wherein the adjusting weight means includes at least one second weight member that the sash member receives at the predetermined position.

4. The fume hood apparatus of claim 2, wherein the adjusting weight means includes one second weight member that is added to the first weight member and that is released from the first weight member at the predetermined position.

5. A fume hood apparatus comprising: a housing with a work chamber, an access opening to the work chamber and a sash member moveable between raised and lowered positions for opening or closing the access opening; first weight means supported by the housing for maintaining the sash member at a desired position; connecting means for connecting the first weight means with the sash member; second weight means for adjusting the magnitude of the first weight means or increasing the weight of the sash member at a predetermined point during the movement of the sash between the raised and lowered positions to allow the sash member to drop to a predetermined position after being raised above that predetermined position.

6. The fume hood apparatus of claim 5, wherein the connecting means includes a cable and a plurality of pulleys rotatably mounted to the housing.

7. The fume hood apparatus of claim 5, wherein the second weight means includes means for connecting to the sash member at the predetermined position.

8. The fume hood apparatus of claim 5, wherein the housing includes guide means for containing the second weight means and guiding the second weight means along a predetermined path.

9. The fume hood apparatus of claim 8, wherein the guide means includes at least one hollow vertical post member.

10. The fume hood apparatus of claim 5, wherein the second weight means includes at least one second weight member with a main body portion and a hook portion.

11. The fume hood apparatus of claim 5, wherein the second weight means is added to the first weight means or releases from the first weight means at the predetermined position.

12. A fume hood apparatus comprising: a housing with a work chamber, an access opening to the work chamber and a sash member moveable between raised and lowered positions for opening or closing the access opening; a counterweight supported by the housing; a cable for connecting the counterweight to the sash member; at least one adjusting weight member disposed in the housing with a connecting portion for connecting the adjusting weight member to the sash member; the adjusting weight member increasing the weight of the sash member at a predetermined point during the movement of the sash between the raised and lowered positions to allow the sash member to drop to a predetermined position after being raised above that predetermined position; the housing including portions for containing the adjusting weight member and guiding the adjusting weight member along a predetermined path.

13. The fume hood apparatus of claim 10, wherein the fume hood includes a first adjusting weight member disposed on one side of the access opening and a second adjusting weight member disposed on the opposite side of the access opening.

14. A fume hood apparatus comprising: a housing with a work chamber, an access opening to the work chamber and a sash member moveable between raised and lowered positions for opening or closing the access opening; a counterweight supported by the housing; a cable for connecting the counterweight to the sash member; an adjusting weight member disposed in the housing with a connecting portion for connecting the adjusting weight member to the counterweight; the adjusting weight member adjusting the magnitude of the counterweight to allow the sash member to drop to a predetermined position after being raised above that predetermined position; the housing including portions for containing the adjusting weight member.

15. An improved fume hood apparatus including a housing with a work chamber, an access opening to the work chamber, and a sash member moveable between raised and lowered positions for opening and closing the access opening and further including counterbalance means for maintaining the sash member at a desired position, wherein the improvement comprises at least one adjusting weight that adjusts the weight provided by the counterbalance means or increases the weight of the sash member when the sash reaches a predetermined position.

16. An improved fume hood apparatus including a housing with a work chamber, an access opening to the work chamber, and a sash member moveable between raised and lowered positions for opening and closing the access opening and further including counterbalance means for maintaining the sash member at a desired position, wherein the improvement comprises at least one adjusting weight that connects automatically with either the weight provided by the counterbalance or the sash and that adjusts the weight provided by the counterbalance means or increases the weight of the sash member when the sash reaches a predetermined position.

* * * * *